US006550270B2

(12) United States Patent
Rudick

(10) Patent No.: US 6,550,270 B2
(45) Date of Patent: Apr. 22, 2003

(54) SEAL COMPRESSION MECHANISM FOR A REFRIGERATION DEVICE

(75) Inventor: Arthur G. Rudick, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 10/063,926

(22) Filed: May 24, 2002

(65) Prior Publication Data

US 2002/0124590 A1 Sep. 12, 2002

(51) Int. Cl.[7] ..... F25D 19/02; F25D 19/00
(52) U.S. Cl. ..... 62/448; 62/297
(58) Field of Search ..... 62/440, 448, 449, 62/237, 297, 382

(56) References Cited

U.S. PATENT DOCUMENTS

| | | | | |
|---|---|---|---|---|
| 2,012,494 A | | 8/1935 | Blood | 62/116 |
| 2,247,904 A | | 7/1941 | Brace | 62/105 |
| 2,511,127 A | | 6/1950 | Philipp | 62/126 |
| 2,523,749 A | | 9/1950 | Wilson | 62/24 |
| 2,638,755 A | | 5/1953 | Borgerd | 62/129 |
| 2,770,954 A | | 11/1956 | Jansen | 62/117.3 |
| 2,968,933 A | | 1/1961 | Pfeifer et al. | 62/176 |
| 2,973,631 A | | 3/1961 | Adkins | 62/246 |
| 3,178,902 A | | 4/1965 | Costantini et al. | 62/237 |
| 3,866,867 A | | 2/1975 | LaRocca | 248/23 |
| 4,052,589 A | | 10/1977 | Wyatt | 219/400 |
| 4,323,110 A | | 4/1982 | Rubbright et al. | 165/2 |
| 4,738,117 A | | 4/1988 | Takasugi | 62/200 |
| 4,802,060 A | * | 1/1989 | Immel | 361/379 |
| 5,417,079 A | | 5/1995 | Rudick et al. | 62/253 |
| 5,417,081 A | | 5/1995 | Rudick et al. | 62/440 |
| 5,694,789 A | * | 12/1997 | Do | 62/441 |
| 5,875,645 A | | 3/1999 | Dunnigan | 62/407 |
| 6,106,084 A | | 8/2000 | Thögersen et al. | 312/306 |
| 6,257,013 B1 | | 7/2001 | Murray et al. | 62/302 |

FOREIGN PATENT DOCUMENTS

| | | | | |
|---|---|---|---|---|
| JP | 6-159925 | * | 6/1994 | 62/382 |
| JP | 6-257935 | * | 9/1994 | 62/382 |
| WO | WO 95/08087 | | 3/1995 | |

OTHER PUBLICATIONS

SONGSERM CKC–018RAX; Cabinet dimensions, single page document.
HABCO ESM12 Planner's Guide; single page document.

* cited by examiner

*Primary Examiner*—Melvin Jones
(74) *Attorney, Agent, or Firm*—Sutherland Asbill & Brennan LLP

(57) ABSTRACT

A refrigeration device. The refrigeration device may include a refrigeration deck frame and a refrigeration deck removably positioned within the refrigeration deck frame. The refrigeration deck may include a sealing member and a seal compression mechanism positioned thereon. The seal compression mechanism may include a rotating member so as to urge the sealing member against the refrigeration deck frame.

20 Claims, 5 Drawing Sheets

SEAL COMPRESSION MECHANISM FOR A REFRIGERATION DEVICE

BACKGROUND OF INVENTION

The present invention relates generally to a refrigeration system and, more particularly, the present invention relates to a mechanism for sealing a refrigeration deck within the refrigeration system.

In the beverage industry and elsewhere, refrigeration systems are found in vending machines, glass door merchandisers ("GDM's"), and other types of dispensers and coolers. These systems generally have used a conventional vapor compression (Rankine cycle) refrigeration apparatus to chill beverages or other products therein. In the Rankine cycle apparatus, the refrigerant in the vapor phase is compressed in a compressor so as to cause an increase in temperature. The hot, high-pressure refrigerant is then circulated through a heat exchanger, called a condenser, where it is cooled by heat transfer to the surrounding environment. As a result, the refrigerant condenses from a gas back to a liquid. After leaving the condenser, the refrigerant passes through a throttling device where the pressure and the temperature of the refrigerant are reduced. The cold refrigerant leaves the throttling device and enters a second heat exchanger, called an evaporator, located in or near the refrigerated space. Heat transfer with the evaporator and the refrigerated space causes the refrigerant to evaporate or to change state from a saturated mixture of liquid and vapor into a superheated vapor. The vapor then leaves the evaporator and is drawn back into the compressor so as to repeat the cycle.

Although the Rankine cycle systems adequately chill the products therein and are in widespread use, there are several known disadvantages. First, the systems are generally large and heavy. Second, the systems may be noisy to operate. Third, the systems may have a significant power draw. Further, conventional Rankine systems generally use refrigerants for their working medium. These refrigerants are known to be harmful to the environment. The refrigerants may in some cases be noxious. In fact, although the commonly used HFC refrigerant (134*a*) is generally assumed not to be noxious, there have been claims to the contrary. This refrigerant, however, is known to be a powerful "greenhouse" gas.

One alternative to the use of a Rankine cycle system is a Stirling cycle cooler. The Stirling cycle cooler is also a well-known heat transfer mechanism. Briefly described, a Stirling cycle cooler compresses and expands a gas (typically helium) to produce cooling. This gas shuttles back and forth through a regenerator bed to develop much greater temperature differentials than may be produced through the normal Rankine compression and expansion process. Specifically, a Stirling cooler may use a displacer to force the gas back and forth through the regenerator bed and a piston to compress and expand the gas. The regenerator bed may be a porous element with significant thermal inertia. During operation, the regenerator bed develops a temperature gradient. One end of the device thus becomes hot and the other end becomes cold. See David Bergeron, Heat Pump Technology Recommendation for a Terrestrial Battery-Free Solar Refrigerator, September 1998. Patents relating to Stirling coolers include U.S. Pat. Nos. 5,678,409; 5,647,217; 5,638,684; 5,596,875; and 4,922,722, all incorporated herein by reference.

Stirling cooler units are desirable because they are nonpolluting, efficient, and have very few moving parts. The use of Stirling coolers units has been proposed for conventional refrigerators. See U.S. Pat. No. 5,438,848, incorporated herein by reference. The integration of a free-piston Stirling cooler into a conventional refrigerated cabinet, however, requires different manufacturing, installation, and operational techniques than those used for conventional compressor systems. See D. M. Berchowitz et al., Test Results for Stirling Cycle Cooler Domestic Refrigerators, Second International Conference. As a result, the use of the Stirling coolers in, for example, beverage vending machines, GDM's, and other types of dispensers, coolers, or refrigerators is not well known.

There is a desire, therefore, for adapting Stirling cooler unit technology to conventional beverage vending machines, GDM's, dispensers, coolers, refrigerators and the like. Specifically, the Stirling cooler units used therein should be easily accessible in the case of repair or replacement while maintaining adequate efficiency. Preferably the Stirling coolers should be accessible with a minimum of down time for the enclosure as a whole and without the need for emptying the enclosure. The beverage vending machine, GDM, or other type of dispenser, cooler, or refrigerator with the Stirling cooling units therein should be both easy to use and energy and thermally efficient.

SUMMARY OF INVENTION

The present invention thus provides a refrigeration device. The refrigeration device may include a refrigeration deck frame and a refrigeration deck removably positioned within the refrigeration deck frame. The refrigeration deck may include a sealing member and a seal compression mechanism positioned thereon. The seal compression mechanism may include a rotating member so as to urge the sealing member against the refrigeration deck frame.

Specific embodiments of the refrigeration device may include the refrigeration deck having a cold compartment and a hot compartment. The refrigeration deck may include a liquid secondary loop heat exchanger. The refrigeration deck may include a Stirling cycle cooler. The refrigeration deck may include an air aperture. The air aperture may be surrounded by the sealing member. The refrigeration deck may include a return aperture and a supply aperture. The sealing member may include a supply aperture sealing member and a return aperture sealing member. The sealing member may be made out of extruded vinyl, compliant elastomeric foam, or extruded compliant foam.

The refrigeration deck may include a number of flanges. One of the seal compression mechanisms may be positioned on each of the flanges. The seal compression mechanism may include a base. The base may be made out of a material with a low coefficient of friction. The base may include a number of apertures therein. A shaft may be positioned for rotation within the base. The rotating member may be fixedly attached to the shaft. A handle may be connected to the shaft such that rotation of the handle will cause rotation of the rotating member. The rotating member may include a tab, a cam, or an elongated member.

The seal compression mechanism may include a shaft positioned for horizontal motion within the base. The shaft may have one or more pins positioned thereon. The rotating member may include a number of cams positioned within the base such that the cams may ride along the pins of the shaft.

The refrigeration deck frame may include a number of rails such that the refrigeration deck may slide thereon. The rotating member of the seal compression mechanism may rotate against the rails so as to lift the refrigeration deck. The refrigeration deck frame may include a first end and a second end. The rails may be positioned about the first end. The rotating member may urge the sealing member against the refrigeration deck frame with less than one (1) revolution or about ninety (90) degrees of rotation.

A further embodiment of the present invention may provide for a refrigeration deck for use in a refrigeration device. The refrigeration deck may include an outer frame and a refrigeration device positioned within the outer frame. A sealing member and a sealing member compression device may be positioned on the outer frame. The sealing member compression device may include a rotating member. The rotating member may urge the sealing member against the refrigeration device with less than one (1) revolution. The rotating member may include a tab, a cam, or an elongated member. The refrigeration device may be a Stirling cycle cooler.

A further embodiment of the present invention may provide for a refrigeration device. The refrigeration device may include a refrigeration deck frame with a refrigeration deck removably positioned therein. A sealing member may be positioned between the refrigeration deck and the refrigeration deck frame. A seal compression mechanism may be positioned about the refrigeration deck and the refrigeration deck frame. The seal compression mechanism may include a rotating member so as to urge the refrigeration deck and the sealing member against the refrigeration deck frame.

The deck may include a Stirling cycle cooler. The sealing member may include compliant foam, rubber, or vinyl. The sealing member and the seal compression mechanism may be attached to the refrigeration deck or the refrigeration deck frame.

The seal compression mechanism may include a base. The base may include a number of apertures therein. A shaft may be positioned for horizontal motion within the base. The shaft may include one or more pins positioned thereon. The rotating member may include a number of cams positioned within the base such that the cams may ride along the pins of the shaft. The cams may include one or more pairs of ramps with a gap therebetween. The rotating member may urge the sealing member against the refrigeration deck frame with less than one (1) revolution.

The method of the present invention may provide for sealing a refrigeration deck within a refrigeration deck frame. The refrigeration deck may include a sealing member and a sealing member compression device. The refrigeration deck frame may include a number of rails positioned therein. The method may include the steps of sliding the refrigeration deck into the refrigeration deck frame along the rails and rotating the sealing member compression device against the rails so as to lift the refrigeration deck and compress the sealing member against the refrigeration deck frame. The refrigeration deck may include a Stirling cycle cooler. The method further may include the step of operating the Stirling cycle cooler.

These and other features of the present invention will become apparent upon review of the following detailed description of the disclosed embodiments when taken in consideration with the drawings and the appended claims.

DETAILED DESCRIPTION

Figure 1:
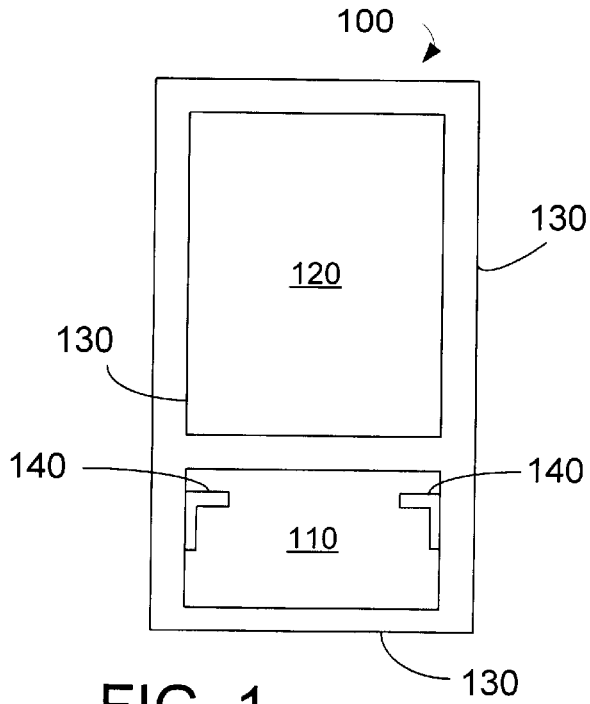
FIG. 1 is a plan view of a refrigeration device for use with the present invention.

Referring now to the drawings, in which like numerals refer to like elements throughout the several views, FIG. 1 shows a refrigeration device 100 for use with the present invention. The refrigeration device 100 may be any type of refrigerated space, such as a refrigerator, a merchandiser, a vending machine, a cooler, a beverage dispenser, or similar types of devices. The refrigeration device 100 may have any desired size, shape, or capacity. The design and organization of the refrigeration device 100 should not limit the scope or applicability or the components described in detail below. Specifically, any type of configuration of the refrigeration device 100 may be used herein. Further, the present invention also may be used with a means to heat a given space as opposed to the refrigeration device 100 described herein.

The refrigeration device 100 may have a refrigeration deck area 110 and a chilled area 120. The refrigeration deck components, as will be described in more detail below, may be positioned largely within or in communication with the refrigeration deck area 110. The products, fluids, or other items to be chilled may be positioned within or in communication with the chilled area 120. The refrigeration deck area 110 may be positioned on the top or the bottom of the refrigeration device 100. One or more frame members 130 may define the refrigeration deck area 170, the chilled area 120, and the refrigeration device 100 as a whole.

Attached to the frame members 130 may be a number of tracks 140. The tracks 140 may be positioned within the refrigeration deck area 110. The tracks 140 may be made out of steel, aluminum, or similar types of materials. The tracks 140 may be largely "L"-shaped. The tracks 140 may be positioned a pre-determined distance beneath the top or the bottom of the refrigeration deck area 110.

Figure 2:
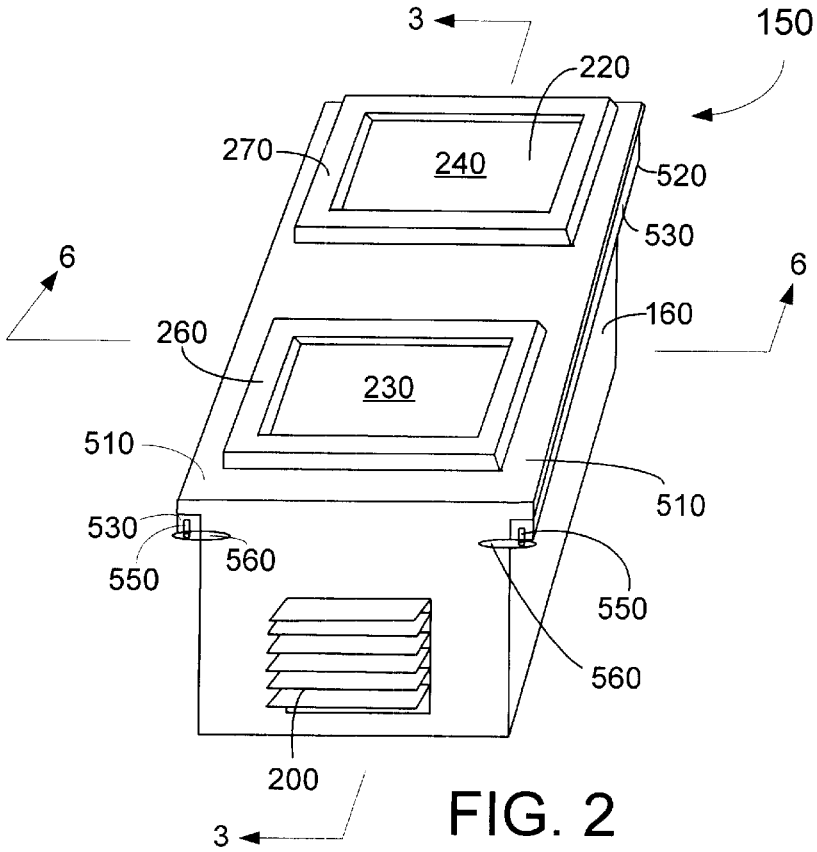
FIG. 2 is a perspective view of a refrigeration deck of the present invention.
Figure 3:
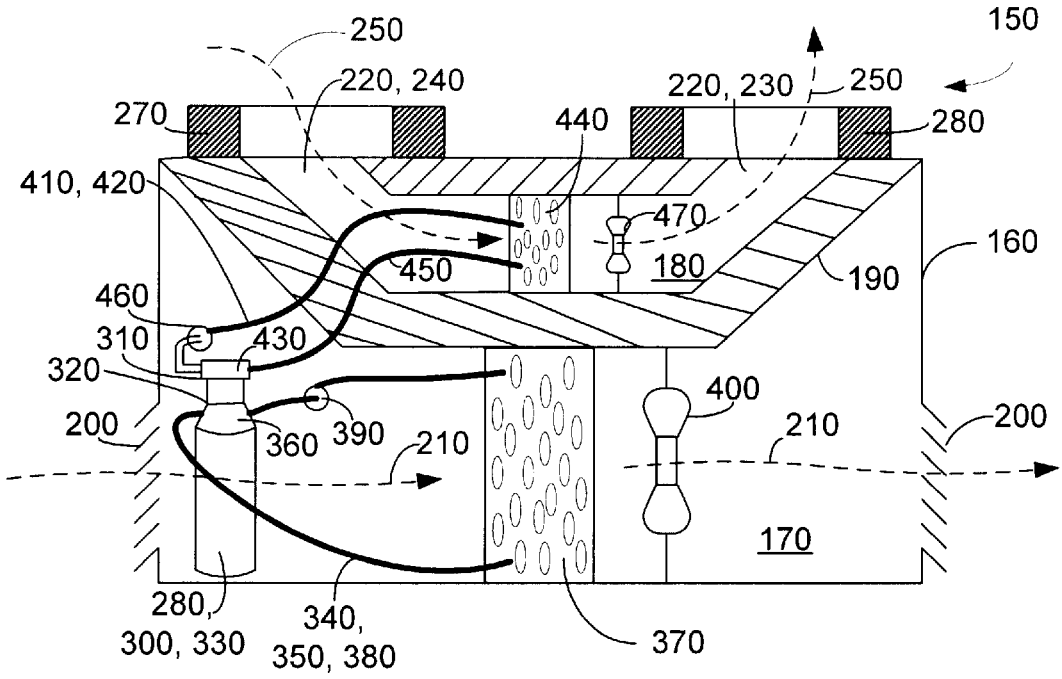
FIG. 3 is a side cross-sectional view of the refrigeration deck of FIG. 2, taken along line 3—3.

FIGS. 2 and 3 show a refrigeration deck 150 of the present invention. The refrigeration deck 150 may include an outer frame 160. The outer frame 160 may be in the form of a largely self-contained box or a similar type of structure. The outer frame 160 may be made out of steel, aluminum, or similar types of materials. The outer frame 160 may be insulated.

The refrigeration deck 150 may include an internal hot compartment 170 and an internal cold compartment 180. A divider 190 may separate the hot compartment 170 and the cold compartment 180. The divider 190 may be insulated. The refrigeration deck 150 may include a number of hot air vents 200 positioned about the hot air compartment 170 of the outer frame 160. The hot air vents 200 may be positioned so as to define a hot air path 210 through the outer frame 160. The refrigeration deck 150 also may define a number of cold air openings 220 positioned adjacent to the cold compartment 180 of the outer frame 160. The cold air openings 220 may define a supply air opening 230 and a return air opening 240. The cold air openings 220 may define a cold air path 250 extending from the return opening 240 to the supply opening 230. The frame member 130 also may include a number of apertures so as to communicate with the supply opening 230 and the return opening 240.

A supply opening sealing layer 260 may surround the supply opening 230. A return opening sealing layer 270 may surround the return opening 240. The sealing layers 260, 270 may take the form of a raised foam layer, an extruded hollow section, or a similar type of structure. The sealing layers 260, 270 may be about 1.2 to about 1.6 centimeters in thickness (uncompressed) and may be about 2.5 to about 3.5 centimeters in width. Any dimensions, however, may be used. The sealing layers 260, 270 may be made out of an elastic material such as vinyl, rubber, or similar types of material so as to provide a substantially air tight seal surrounding the cold air openings 220.

Positioned within the outer frame 160 of the refrigeration deck 150 may be a number of refrigeration components 280. In this embodiment, a Stirling cooler 300 is shown. As is well known, a Stirling cooler may include a cold end 310 and a hot end 320. The Stirling cooler 300 may be driven by a free piston (not shown) positioned within a casing 330. By way of example, the Global Cooling Company of Athens, Ohio may manufacture a Stirling cooler 300 suitable for use with the present invention. Any conventional type of Stirling cooler 300, however, may be used herein. Further, any number of Stirling coolers 300 may be used herein. Although the use of the Stirling cooler 300 has been shown herein, any other type of refrigeration system may be used. For example, a Rankine cycle or a transcritical carbon dioxide cycle system also may be used within the refrigeration deck 150.

The Stirling cooler 300 may be positioned within the hot compartment 170 of the refrigeration deck 150. Alternatively, the Stirling cooler 300 may be positioned with the hot end 320 positioned within the hot compartment 170 while the cold end 310 may be positioned on the other side of the divider 190 within the cold compartment 180. Any suitable positioning of the Stirling cooler 300 may be used.

The refrigeration components 280 also may include a hot compartment heat transfer system 340. The hot compartment heat transfer system 340 may be positioned within the hot compartment 170 of the refrigeration deck 150. In the embodiment, the hot compartment heat transfer system 340 may include a liquid secondary loop heat exchanger 350. Alternatively, a thermosiphon, a radial fin, or a similar system may be used. The liquid secondary loop heat exchanger 350 may include a fluid heat exchanger 360 attached to the hot end 320 of the Stirling cooler 300. The liquid secondary loop heat exchanger 350 also may include a hot end heat exchanger 370 positioned within the hot air path 210. The hot end heat exchanger 370 may be a conventional fin and tube type heat exchanger. Alternatively, a microchannel hex or a roll bonded hex also may be used. The fluid heat exchanger 360 and the hot end heat exchanger 370 may be connected by a series of tubing 380. The tubing 380 may be made out of vinyl, rubber, or similar types of materials. The tubing 380 may be insulated. A pump 390 also may be positioned between the fluid heat exchanger 360 and the hot end heat exchanger 370 so as to pump the refrigeration fluid through the liquid secondary loop heat exchanger 350. The pump 390 may have a capacity of about 500 to 1,500 milliliters per minute. A fan 400 may be positioned adjacent to the hot end heat exchanger 370 so as to force air along the cold air path 250. The fan 400 may have a capacity of about 100 to 200 cubic feet per minute.

The refrigeration components 280 may include a cold compartment heat transfer system 410. The cold compartment heat transfer system 410 may be positioned within the cold compartment 180 of the refrigeration deck 150. In the embodiment, the cold compartment heat transfer system 410 may include a liquid secondary loop heat exchanger 420. Alternatively, a thermosiphon, a finned cold plate, or a similar system may be used. The liquid secondary loop heat exchanger 420 may include a fluid heat exchanger 430 attached to the cold end 310 of the Stirling cooler 300. The liquid secondary loop heat exchanger 420 also may include a cold end heat exchanger 440 positioned within the cold air path 250. The cold end heat exchanger 440 may be a conventional fin and tube type heat exchanger. Alternatively, a roll bonded hex or a microchannel hex also may be used. The fluid heat exchanger 430 and the cold end heat exchanger 440 may be connected by a series of tubing 450. The tubing 450 may be made out of vinyl, rubber, or similar types of materials. The tubing 450 may be insulated. A pump 460 also may be positioned between the fluid heat exchanger 430 and the cold end heat exchanger 440 so as to pump the refrigeration fluid through the liquid secondary loop heat exchanger 420. The pump 460 may have a capacity of about 500 to 1,500 milliliters per minute. A fan 470 may be positioned adjacent to the cold end heat exchanger 440 so as to force air along the cold air path 250. The fan 470 may have a capacity of about 100 to 200 cubic feet per minute.

The outer frame 160 of the refrigeration deck 150 may include a number of flanges, in this case a first upper flange 500 and a second upper flange 510. The flanges 500, 510 may be positioned about the top of the outer frame 160. The flanges 500, 510 may be integral with the outer frame 160 or the flanges 500, 510 may be fixedly attached thereto.

Figure 4:
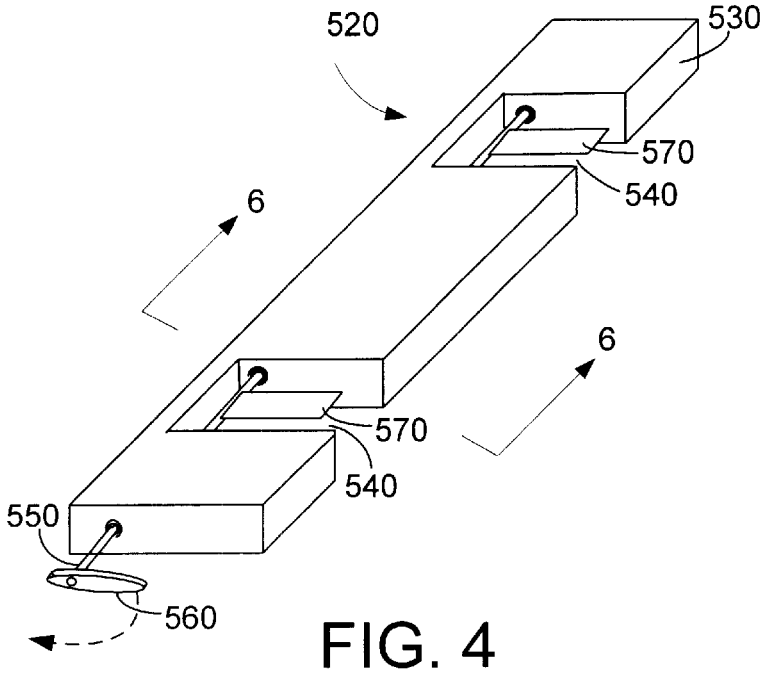
FIG. 4 is perspective view of the seal compression mechanism of the present invention.

As is shown in FIGS. 2 and 4, a seal compression mechanism 520 may be mounted underneath each upper flange 500, 510. The seal compression mechanism 520 may include a block 530. The block 530 preferably may be made with a material having a low coefficient of friction. The block 530 may be made out of a plastic such as Delrin (acetal resin), Celcon (acetal copolymer), nylon, UHMWPE (ultra-high molecular weight polyethylene), or similar types of materials. Alternatively, other types of plastics also may be used.

The block 530 may have a number of notches 540 positioned therein. In this embodiment, two notches 540 may be used. Any number of notches 540, however, may be used. The notches 540 will be sized as is described in more detail below. A shaft 550 may run through the block 530 and extend through the notches 540. The shaft 550 may be made out of a metal such as steel, aluminum, or similar types of materials. A handle 560 may be attached to one end of the shaft 550.

Attached to the shaft 550 and positioned within each of notches 540 may be a tab 570. The tabs 570 may be attached to the shaft 550 by welding, a set screw, or similar types of joinder means. One tab 570 may be positioned within each of the notches 540. Any number of tabs 570 may be used. The tabs 570 may be made out of metal, plastic, or similar types of materials. The tabs 570 may be positioned onto the shaft 550 such that the tabs 570 rotate with the shaft 550 when the handle 560 is rotated.

Figure 5:
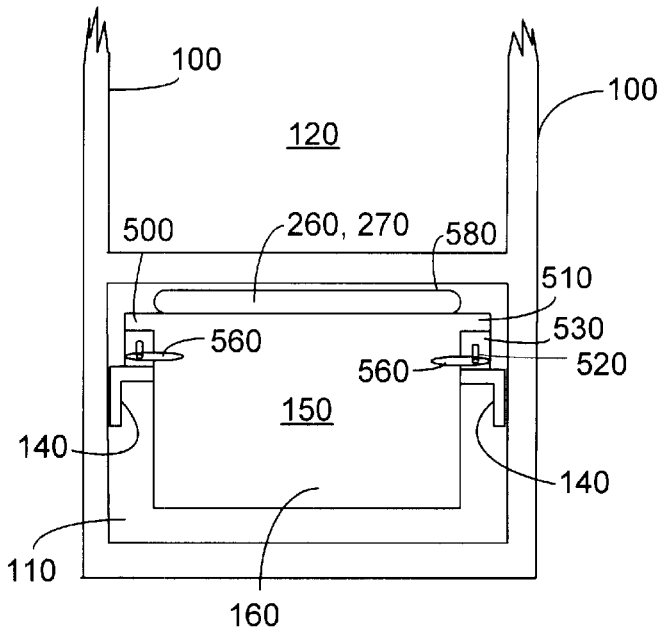
FIG. 5 is a plan view of a refrigeration device with the refrigeration deck of FIG. 2 positioned therein.

FIG. 5 shows the positioning of the refrigeration deck 150 within the refrigeration deck area 110 of the refrigeration device 100. Specifically, the block 530 of the seal compression mechanism 520 is positioned along the tracks 140 within the refrigeration deck area 110. The refrigeration deck 150 may slide in and out of the refrigeration deck area 110 along the tracks 140.

Figure 6:
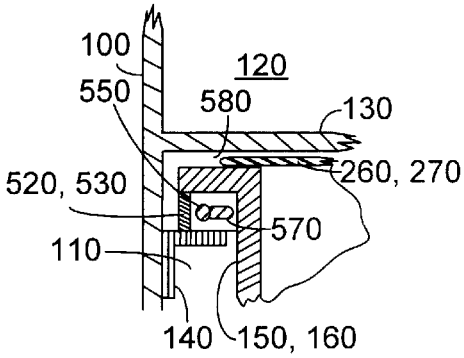
FIG. 6 is a side cross-sectional view of the refrigeration deck positioned within the refrigeration device taken along line 6—6.
Figure 7:
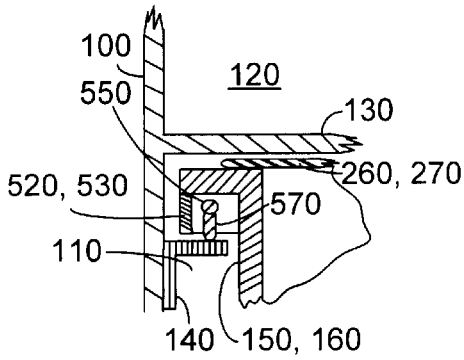
FIG. 7 is a side cross-sectional view of the refrigeration deck positioned within the refrigeration device taken along line 6—6.

FIGS. 6 and 7 show the use of the seal compression mechanism 520. In FIG. 6, the seal compression mechanism 520 is unengaged. As can be seen, the sealing layers 260, 270 are in their uncompressed state and a gap 580 exists between the sealing layers 260, 270 and the frame member 130 that acts as the floor for the chilled area 120. As is shown in FIG. 7, when the handle 560 of the seal compression mechanism 520 is rotated, the shaft 550 rotates the tabs 570 against the tracks 140. The refrigeration deck 150 as a whole is then forced towards the frame member 130 as the tabs 570 lift the refrigeration deck 150. The sealing layers 260, 270 are compressed so as to define a substantially air tight seal around the supply opening 230 and the return opening 240. Specifically, the tabs 570 act as cams to push against the tracks 140 at all four (4) corners so as to lift the refrigeration deck 150 straight up and uniformly compress the sealing layers 260, 270. The refrigeration deck 150 is thus adequately sealed within the refrigeration deck area 110 of the refrigeration device 100.

In removing the refrigeration deck 150 from the refrigeration deck area 110, the handle 560 of the seal compression mechanism 520 is simply rotated such that the tabs 570 disengage from the tracks 140. The refrigeration deck 150 as a whole is then lowered such that the blocks 530 come in contact with the tracks 140. The sealing layers 260, 270 may disengage from the frame member 130 and the gap 580 may reappear. The sealing layers 260, 270 may be compressed from about 1.2 to about 1.6 centimeters to about 0.8 to about 1.0 centimeters. The dimension may vary according to the size of the refrigeration device 100 as a whole. The refrigeration deck 150 may then be slid along the tracks 140 and removed from the refrigeration deck area 110 of the refrigeration device 100.

Figure 8:
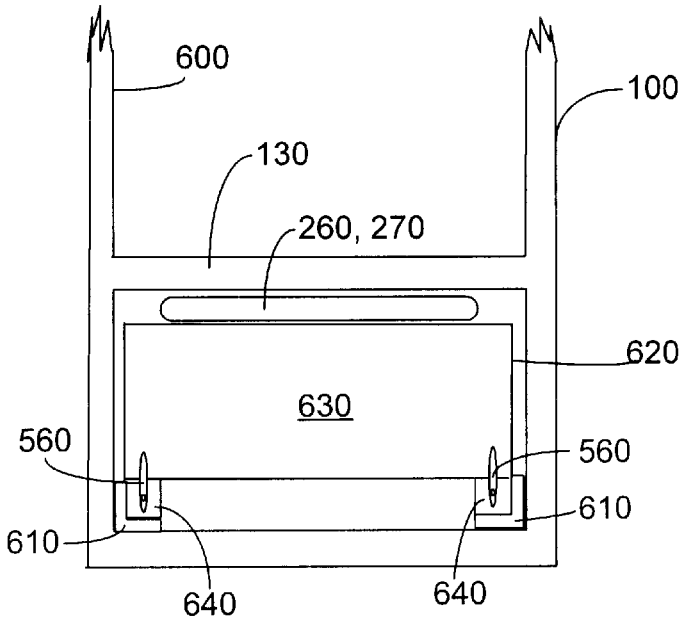
FIG. 8 is a plan view of an alternative refrigeration deck positioned within the refrigeration device.
Figure 9:
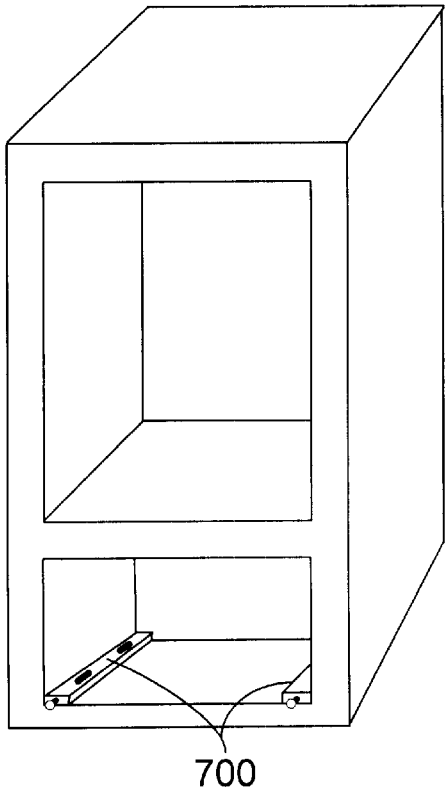
FIG. 9 is a perspective view of an alternative seal compression mechanism positioned within the refrigeration deck.

FIG. 8 shows an alternative embodiment of the present invention, a refrigeration device 600. The refrigeration device 600 may be substantially identical to the refrigeration device 100 described above, with the exception that a pair of tracks 610 may be positioned at the bottom of a refrigeration deck area 620 as opposed to the positioning of the tracks 140 near the top of the refrigeration deck 110. A refrigeration deck 630 may be substantially identical to the refrigeration deck 150 described above, with the exception that the flanges 500, 510 may be not be required. Rather, a number of seal compression mechanisms 640 may be mounted on the bottom of the refrigeration deck 630.

In this configuration, the refrigeration deck 630 may be slid across the tracks 610 into place within the refrigeration deck area 620. The seal compression mechanism 640 then may operate in a substantially identical manner to that described above. Specifically, by turning the handles 560, the shaft 550 rotates the tabs 570 so as to elevate the refrigeration deck 630 into place. In raising the refrigeration deck 630, the sealing layers 260, 270 may form a substantially air tight seal against the frame member 130.

A further embodiment of the present invention is shown in FIGS. 9–12, a refrigeration device 650. The refrigeration device 650 may be substantially identical to the refrigeration device 100 described above, with the exception that the tracks 140 may be omitted. Likewise, a refrigeration deck 660 may be substantially identical to the refrigeration deck 150 described above, with the exception that the flanges 500, 510 may be not be required.

Figure 10:
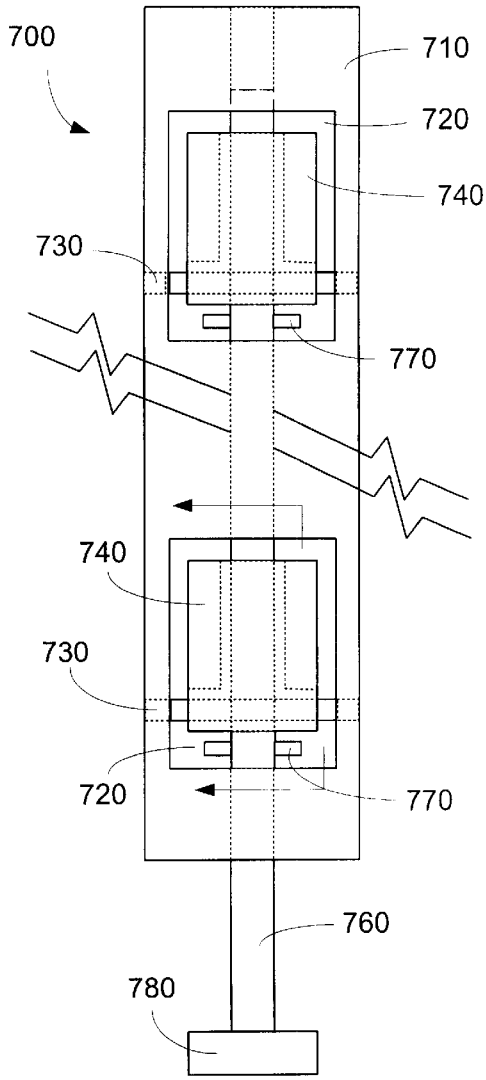
FIG. 10. is a cross-sectional view of an alternative seal compression mechanism.

In this embodiment, a pair of seal compression mechanisms 700 may be located at the bottom edges of the refrigeration device 650. Referring to FIG. 10, each seal compression mechanism 700 may include a block 710 with two or more apertures 720 therein. The block 710 may be similar to the block 530 described above. A lifting cam 740 may be located in each aperture 720. The lifting cams 740 may be made out of metal, plastic, or similar types of materials. A hinge pin 730 may anchor the lifting cam 740 within the aperture 720 of the block 710. The lifting cams 740 may pivot about the hinge pin 730. The lifting cams 740 may include two actuation ramps 750 located thereon. The actuation ramps 750 may be placed so as to define a gap between them.

Figure 11:
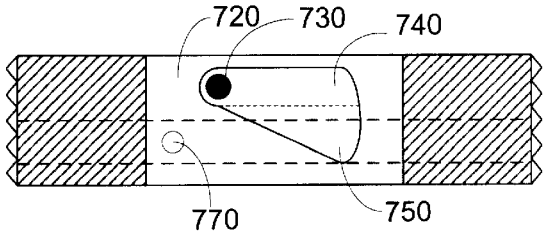
FIG. 11. is a plan view of the alternative seal compression mechanism in the disengaged position.
Figure 12:
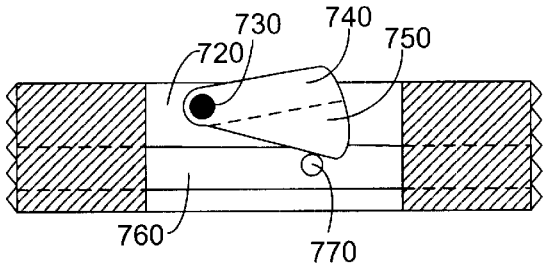
FIG. 12. is a plan view of the alternative seal compression mechanism in the engaged position.

A rod 760 may run substantially all the way through the block 710 and extend beyond the block 710 so as to terminate in a handle 780. Inside each aperture 720, two actuation pins 770 may extend perpendicularly from the rod 760. As is shown in FIG. 11, the rod 760 rests between the actuation ramps 750 in the retracted position. The top surface of the actuation ramp 750 may be parallel to and flush with or slightly below the top surface of block 710. As is shown in FIG. 12, the rod 760 slides within the block 710 such that the actuation pins 770 contact the actuation ramps 750 of the actuation cams 740 in the engaged position. As the rod 760 continues forward, the actuation cams 750 angle up so as to push on the bottom of the refrigeration deck 610.

In use, the refrigeration deck 610 slides into the refrigeration device 650 such that the deck 610 rests on the blocks 710. When the deck 610 is fully inserted, the user pushes in on the handles 780 such that the actuation pins 770 raise the deck 610 and compress the seals 260, 270. To remove the deck 650, the user pulls the handles 780 out, so as to return the actuator ramps 750 to the retracted position. The configuration shown in this embodiment could be inverted such that the seal compression mechanisms 700 are attached to the bottom of the deck 650 and act against the tracks similar to those shown in FIG. 8.

It should be apparent that the foregoing relates only to the preferred embodiments of the present invention and that numerous changes and modifications may be made herein without departing from the spirit and scope of the invention as defined by the following claims and the equivalents thereof.

I claim:

1. A refrigeration device, comprising:

a refrigeration deck frame; and a refrigeration deck removably positioned within said refrigeration deck frame;

said refrigeration deck comprising a sealing member positioned thereon;

said refrigeration deck comprising a seal compression mechanism positioned thereon;

said seal compression mechanism comprising a rotating member so as to urge said sealing member against said refrigeration deck frame.

2. The refrigeration device of claim 1, wherein said sealing member comprises compliant foam, rubber, or vinyl.

3. The refrigeration device of claim 1, wherein said refrigeration deck comprises a plurality of flanges and wherein said seal compression mechanism comprises a plurality of seal compression mechanisms such that one of said plurality of seal compression mechanisms is positioned on said plurality of flanges.

4. The refrigeration device of claim 1, wherein said seal compression mechanism comprises a base.

5. The refrigeration device of claim 1, wherein said base comprises a low coefficient of friction.

6. The refrigeration device claim 4, wherein said base comprises a plurality of apertures therein.

7. The refrigeration device of claim 4, wherein said seal compression mechanism comprises a shaft positioned for rotation within said base and wherein said rotating member is fixedly attached to said shaft.

8. The refrigeration device of claim 7, wherein said seal compression mechanism comprises a handle connected to said shaft such that rotation of said handle will cause rotation of said rotating member.

9. The refrigeration device of claim 4, wherein said seal compression mechanism comprises a shaft positioned for horizontal motion within said base.

10. The refrigeration device of claim 9, wherein said shaft comprises one or more pins positioned thereon.

11. The refrigeration device of claim 10, wherein said rotating member comprises a plurality of cams positioned within said base such that said plurality of cams may ride along said one or more pins of said shaft.

12. The refrigeration device of claim 1, wherein said rotating member comprises a tab.

13. The refrigeration device of claim 1, wherein said rotating member comprises a cam.

14. The refrigeration device of claim 1, wherein said rotating member comprises an elongated member.

15. The refrigeration device of claim 1, wherein said refrigeration deck frame comprises a plurality of rails such that said refrigeration deck may slide thereon.

16. The refrigeration device of claim 15, wherein said rotating member of said seal compression mechanism rotates against said plurality of rails so as to lift said refrigeration deck.

17. The refrigeration device of claim 1, wherein said rotating member urges said sealing member against said refrigeration deck frame with less than one (1) revolution.

18. The refrigeration device of claim 17, wherein said rotating member urges said sealing member against said refrigeration deck frame with about ninety (90) degrees of rotation.

19. A refrigeration deck for use in a refrigeration device, comprising:

an outer frame;

a refrigeration device positioned within said outer frame;

a sealing member positioned on said outer frame; and a sealing member compression device positioned on said outer frame;

said sealing member compression device comprising a rotating member such that said rotating member may urge said sealing member against the refrigeration device with less than one (1) revolution.

20. A method for sealing a refrigeration deck within a refrigeration deck frame, said refrigeration deck including a sealing member and a sealing member compression device, said refrigeration deck frame including a number of rails positioned therein, said method comprising the steps of:

sliding said refrigeration deck into said refrigeration deck frame along said rails; and rotating said sealing member compression device against said rails so as to lift said refrigeration deck and to compress said sealing member against said refrigeration deck frame.

* * * * *